US005188244A

United States Patent [19]

Hollstegge

[11] Patent Number: 5,188,244

[45] Date of Patent: Feb. 23, 1993

[54] DRYING RACK FOR FREEZER BAGS AND LIKE ARTICLES

[76] Inventor: Jerome E. Hollstegge, 225 E, 79th St., New York, N.Y. 10021

[21] Appl. No.: 851,571

[22] Filed: Mar. 16, 1992

[51] Int. Cl.[5] ..... A47G 29/00

[52] U.S. Cl. ..... 211/71; 211/13; 248/95

[58] Field of Search ..... 211/13, 71; 34/239, 34/240; 248/95, 97, 311.3, 99

[56] References Cited

U.S. PATENT DOCUMENTS

| | | | |
|---|---|---|---|
| D. 243,313 | 2/1977 | Varnado | D7/196 |
| 1,281,927 | 10/1918 | Felton | 211/37 |
| 1,444,264 | 2/1923 | O'Neill | 211/37 X |
| 1,823,840 | 9/1931 | Nolte | 211/37 X |
| 1,969,716 | 8/1934 | Cohen | 211/33 |
| 2,094,810 | 10/1937 | Oppenheimer | 211/33 |
| 2,664,207 | 12/1953 | Bustamante | 248/311.3 X |
| 3,608,738 | 9/1971 | Anderson | 211/38 |
| 3,730,354 | 5/1973 | Bronstein | 211/38 |
| 5,080,237 | 1/1992 | Hefner | 211/13 |

*Primary Examiner*—Blair M. Johnson
*Attorney, Agent, or Firm*—Natter & Natter

[57] ABSTRACT

A knockdown drying rack for freezer bags and like articles includes a support base, a plurality of rods for releasable attachment at a first end to the base in a vertical orientation and a plurality of head members selectively securable in a horizontal orientation to an upper end of the rod member. The freezer bag is placeable over the head member in an inverted position with the mouth of the bag positioned above the base. The head member lies contiguous to a bottom seam of a bag and expands the bag for drainage and air drying.

3 Claims, 1 Drawing Sheet

DRYING RACK FOR FREEZER BAGS AND LIKE ARTICLES

TECHNICAL FIELD

This invention relates generally to a knockdown stand and especially to a drying rack for accommodating food storage bags.

In particular, the drying rack of this invention concerns a construction formed by the selective assembly of component members sized for correspondence with the respective bag dimensions.

BACKGROUND ART

The use of plastic pouches for the storage of leftover food or for retaining non-food items is a common practice made even more convenient by pressure sensitive strips for sealing the mouth of the bag. The food pouches are generally referred to as freezer bags such as typically distributed under the trademarks GLAD-LOCK and ZIPLOC.

A problem encountered when using freezer bags, especially for food storage, is that after the contents have been removed, a residue and/or food odor remains within the bag, thus making it impractical to reuse the bag for other food items. Rather than to dispose of the bag, a more economical and environmentally expedient procedure is to thoroughly wash and then re-use the bags.

It has been found difficult however, to satisfactorily drain and dry these bags especially for the reason that as a result of the relatively thin wall construction and single seam edge sealing, the walls tend to adhere and thus prevent adequate drainage and effective air drying. Makeshift solutions to this problem, such as by placing the mouth of the bag over pop bottles or soda cans, does not provide a satisfactory remedy. Furthermore, it is inconvenient to locate within the household, appropriate sized articles such as the previously mentioned containers for accommodating different size bags.

Another disadvantage of using the aforementioned articles is that they do not effectively separate the walls of the bag for maximum air to wall surface contact.

Previous drying devices such as shown in U.S. Pat. Nos. 1,281,927, 3,608,738 and 3,730,354 were directed to boot drying. Consequently, the aforementioned devices did not provide the applicability for use with freezer bags nor did those devices have the versatility for alternate assembly of the component parts in conformity with the proportions of the bag to be dried.

Another device for drying gloves was described in U.S. design Pat. No. 243,313 however, there was no suggestion in that glove drying device for expanding the interior volume of the article as in the instant invention.

BRIEF SUMMARY OF THE INVENTION

The nature of the invention involves a drying rack for freezer bags having component members in alternate sizes that can be selectively assembled to accommodate a range of bag sizes.

The drying rack includes a base member having a plurality of apertures for releaseably securing a plurality of vertical rod members. A head member is mountable to an upper end of the rod member. The height of the rod member is selected for correspondence with the depth dimension of the bag and the length of the horizontal head member corresponds to the width dimension of the bag.

A feature of this invention is that the head member is adapted for coaction with the bag for spacing the walls of the bag for drainage and air contact.

Furthermore, the respective rod members and head members are provided in a range of sizes and are interchangeably connectable for maximizing the versatility of the rack.

Having thus summarized the invention, it will be seen that it is an object thereof to provide a drying rack for freezer bags and like articles of the general character described herein which is not subject to the aforementioned disadvantages.

Another object of this invention is to provide a drying rack for freezer bags that can accommodate a range of bag sizes.

A further object of this invention is to provide a drying rack for freezer bags having a knockdown construction for providing compact storage.

Still another object of this invention is to provide a drying rack for freezer bags providing effective drainage and adequate air circulation for rapid drying.

Yet another object of this invention is to provide a drying rack for freezer bags which is simple in construction, reliable in use and well adapted for mass production fabrication techniques.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention.

DETAILED DESCRIPTION OF THE INVENTION

Figure 3:
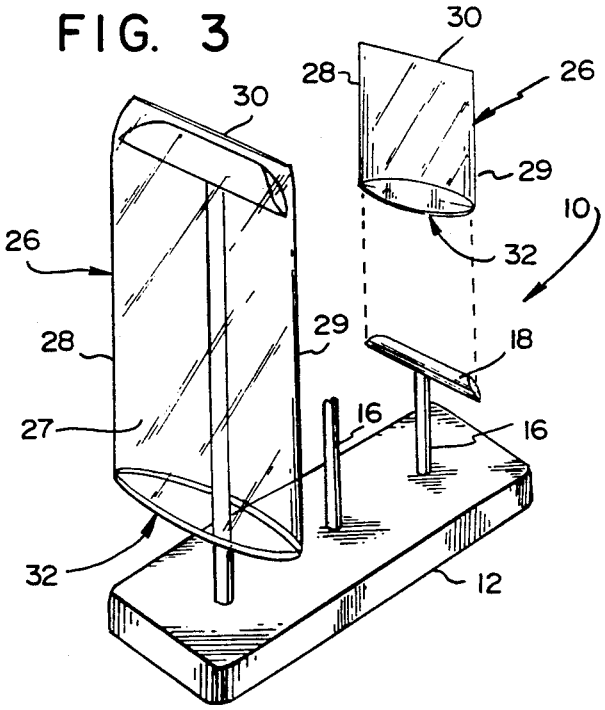
FIG. 3 is perspective view showing a typical application of the device for drying freezer bags.

Referring now in detail to the drawings, the reference numeral 10 denotes generally a drying rack for freezer bags in accordance with this invention.

The rack 10 includes a support base 12 having a plurality of apertures 14. A series of rod members 16, preferably having uniform diameter, are provided in progressively increasing lengths corresponding to the depth dimensions of commonly available freezer bags. A plurality of head members 18 include sockets 20 adapted for releaseably receiving an upper end 22 of the rod member 16 for orientation along a perpendicular axis with respect to a longitudinal axis of the rod 16. A lower end 24 of the rod member 16 is adapted for releasable securement within a selected aperture 14 for vertical positioning.

By way of example, the base member can typically be manufactured from a block of wood having a six (6)

inch length dimension, two and a half ($2\frac{1}{2}$) inch width dimension and three quarter ($\frac{3}{4}$) inch height dimension. The apertures 14 are typically slightly greater than one quarter ($\frac{1}{4}$) inch diameter as is the diameter of the socket 20. The rod members 16, for example are one quarter ($\frac{1}{4}$) inch diameter and have respective lengths of six and three quarter ($6\frac{3}{4}$) inch, nine and three quarter ($9\frac{3}{4}$) inch and twelve and three quarter ($12\frac{3}{4}$) inch. The head members, can for example be two (2) inches, four (4) inches and six (6) inches in length, respectively and can have a width dimension of three quarters ($\frac{3}{4}$) of an inch and a height dimension of three quarters ($\frac{3}{4}$) of an inch. It should also be understood that the previously described components can be manufactured of a plastic or equivalent materials for durability.

Figure 2:
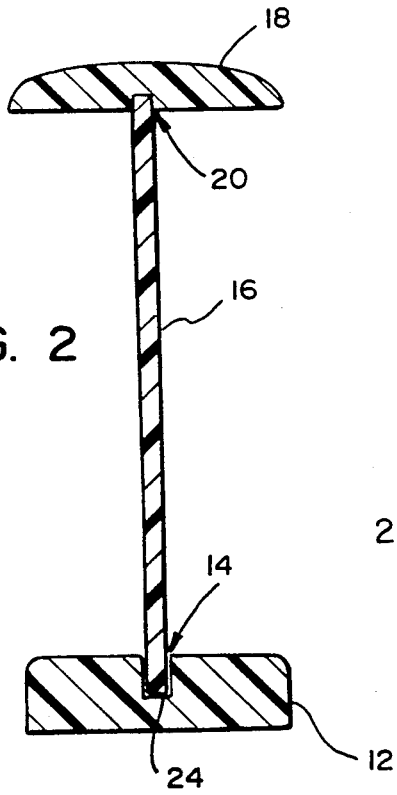
FIG. 2 is a sectional view taken substantially along line 2-2 of FIG. 1 illustrating the interfitting connection of the component.
Figure 1:
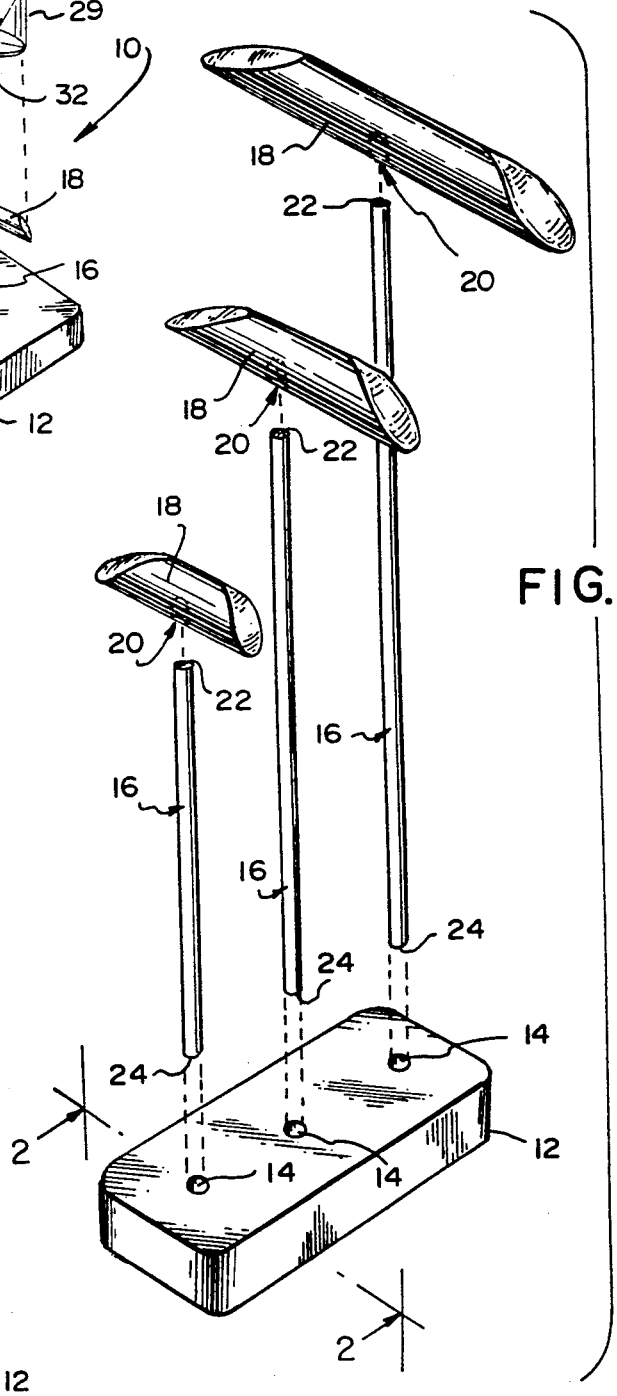
FIG. 1 is an exploded perspective view of the drying rack of this invention showing a selected assembly of component members.

Furthermore, the releasable interconnection of the rod member 16 with the base member 12 and the head member 18, as shown in FIG. 2 is a friction fit so that the component members can be readily disassembled when the rack 10 is no longer in use. It should also be noted that other releasable interconnections can be used such as for example, a screw threaded engagement or a clamp type retainer.

The application of the rack 10 will be described with reference to FIG. 3 wherein a freezer bag 26 is shown in a drying position. The freezer bag 26 is typically constructed of a sheet plastic material having a pair of side walls 27 sealed along opposed side edges 28, 29 and along a bottom edge 30. The walls 27 of the freezer bag 26, when empty, have a tendency to cling together, thus hindering drainage and air circulation within the interior of the bag 26 for effective drying.

The head member 18 is designed to lie contiguous to the bottom edge 30 of the bag 26 and to thus separate the walls 27 and expand the interior volume of the bag 26 for enhanced drainage and air drying.

The bag 26 is placed over the head member 18 in an inverted position, as shown in FIG. 3, with a mouth 32 of the bag 26 positioned above the base 12.

It should be further noted that the plurality of rod members 16 and the head members 18 can be interchangeably assembled such that the length of the rod member 16 and the head member 18 correspond to the respective depth and width dimensions of the bag 26.

It is further intended that the rack 10 be disassembled after use for space-saving storage.

Having thus described the invention, it should be seen that there is provided a drying rack for freezer bags and like articles which achieves the various objects of this invention and which is well adapted to meet conditions of practical use.

Since various possible embodiments might be made of the present invention or modifications might be made to the exemplary embodiment above set forth, it is to be understood that all materials shown or described in the accompanying drawings are to be interpreted as illustrative and not in a limiting sense.

Having thus described the invention, there is claimed as new and desired to be secured by Letters Patent:

1. A drying rack in combination with at least one-size bag suitable for frozen food storage, said rack being adapted for accommodating a plurality of different size food storage bags in an inverted position for drainage and air drying, said rack comprising a plurality of rod members corresponding in length to the depth dimensions of different size bags, at least one head member, said head member being releasably attachable to one of said rod members at an upper end of the rod member and positioned perpendicular to a longitudinal axis of the rod member, said head member having a length dimension corresponding to a width dimension of the bag with the mouth of said bag being placeable over the head member to expand the interior volume of the bag, a base member having a plurality of aperture means for receiving a lower end of the rod member and for securing the rod member in a substantially vertical orientation with the mouth of the bag positioned above the base member, whereby the rod members and at least one head member are selectively interconnected and have readily releasable connections adapted for ready knockdown and construction of the rack.

2. A drying rack as claimed in claim 1 further including a plurality of head members each sized for correspondence with the respective dimensions of a plurality of different size bags and adapted for selective assembly to simultaneously accommodate a plurality of bags.

3. A drying rack as claimed in claim 1 wherein the bag includes two side walls sealed at opposite side edges, a seam connecting the side walls along a bottom edge, said head member being adapted for cooperatively engaging the bottom edge for separating the side walls of the bag to expand the interior volume thereof.

* * * * *